United States Patent [19]

Vanaman

[11] Patent Number: 5,054,862

[45] Date of Patent: Oct. 8, 1991

[54] INFORMATION DISPENSING CONTAINER

[76] Inventor: Cynthia L. Vanaman, 1091 Vessel La., Manahawkin, N.J. 08050

[21] Appl. No.: 529,121

[22] Filed: May 25, 1990

[51] Int. Cl.[5] ..... A47B 81/00

[52] U.S. Cl. ..... 312/100; 232/17

[58] Field of Search ..... 312/211, 100, 292; 232/17, 39, 24, 43.1

[56] References Cited

U.S. PATENT DOCUMENTS

| | | | |
|---|---|---|---|
| 1,579,665 | 4/1926 | Sherry | 232/17 |
| 1,912,531 | 6/1933 | Lawson | 232/43 X |
| 1,918,744 | 7/1933 | Fazekas | 312/211 X |
| 2,880,904 | 4/1959 | Linthicum | 312/292 X |

FOREIGN PATENT DOCUMENTS

| | | | |
|---|---|---|---|
| 724064 | 11/1966 | Italy | 232/17 |

*Primary Examiner*—Joseph Falk
*Attorney, Agent, or Firm*—Ferrill and Logan

[57] ABSTRACT

A real estate sales aid is disclosed in the form of a three-dimensional house which may be mounted next to the "For Sale" sign on property for sale. It includes a first chamber containing sheets providing information as to the house for sale. This chamber is accessible to the public through a hinged door. A second locked chamber is provided into which a reply card may be inserted through a mail slot.

4 Claims, 3 Drawing Sheets

INFORMATION DISPENSING CONTAINER

BACKGROUND OF THE INVENTION

In the sale of real estate today, many prospective purchasers will drive around the area in which they are interested in purchasing a house, view those houses for sale from the outside, and make notes as to those in which they might be interested. At the time of the present invention, there was no way, other than reading real estate ads and calling a listing agent, the prospective purchaser could obtain all pertinent information concerning the house for sale. It would be of assistance to both the prospective buyer and the seller if the buyer could stop in front of the property for sale, pick up an information data sheet including such information as asking price, taxes, lot size, number of rooms, utility costs, etc., and then leave a reply card if interested, so that the owner or sales agent could contact the prospective purchaser.

With the foregoing in mind, a principal object of the present invention is to provide a novel information dispensing container that is attractive and attention-getting in appearance, that may be displayed on real estate to be sold, that may contain easily accessible data sheets concerning the property, and be capable of receiving reply cards if the prospective purchaser is interested in further pursuing the property.

Other objects of the present invention will be readily apparent from the following description of the invention.

BRIEF SUMMARY OF THE INVENTION

The present invention relates to an information dispensing container for use as a real estate sales aid, primarily in the resale of houses. The sales aid is in the form of a threedimensional house which may be displayed on the property to be sold with the sales aid having a first chamber accessible to the public through a hinged or pivoted door containing information data sheets on the property for sale, and a second chamber accessible only to the real estate agent or house owner, having a slot through which a prospective purchaser may insert a reply card. The information dispensing container includes a body portion with rear, side, top and bottom walls and a front cover terminating short of the bottom wall providing an access opening to the container. A dividing wall divides the interior of the container into upper and lower chambers with access to the upper chamber through a mail slot in the front cover and access to the lower chamber through the access opening.

DETAILED DESCRIPTION OF THE INVENTION

Figure 1:
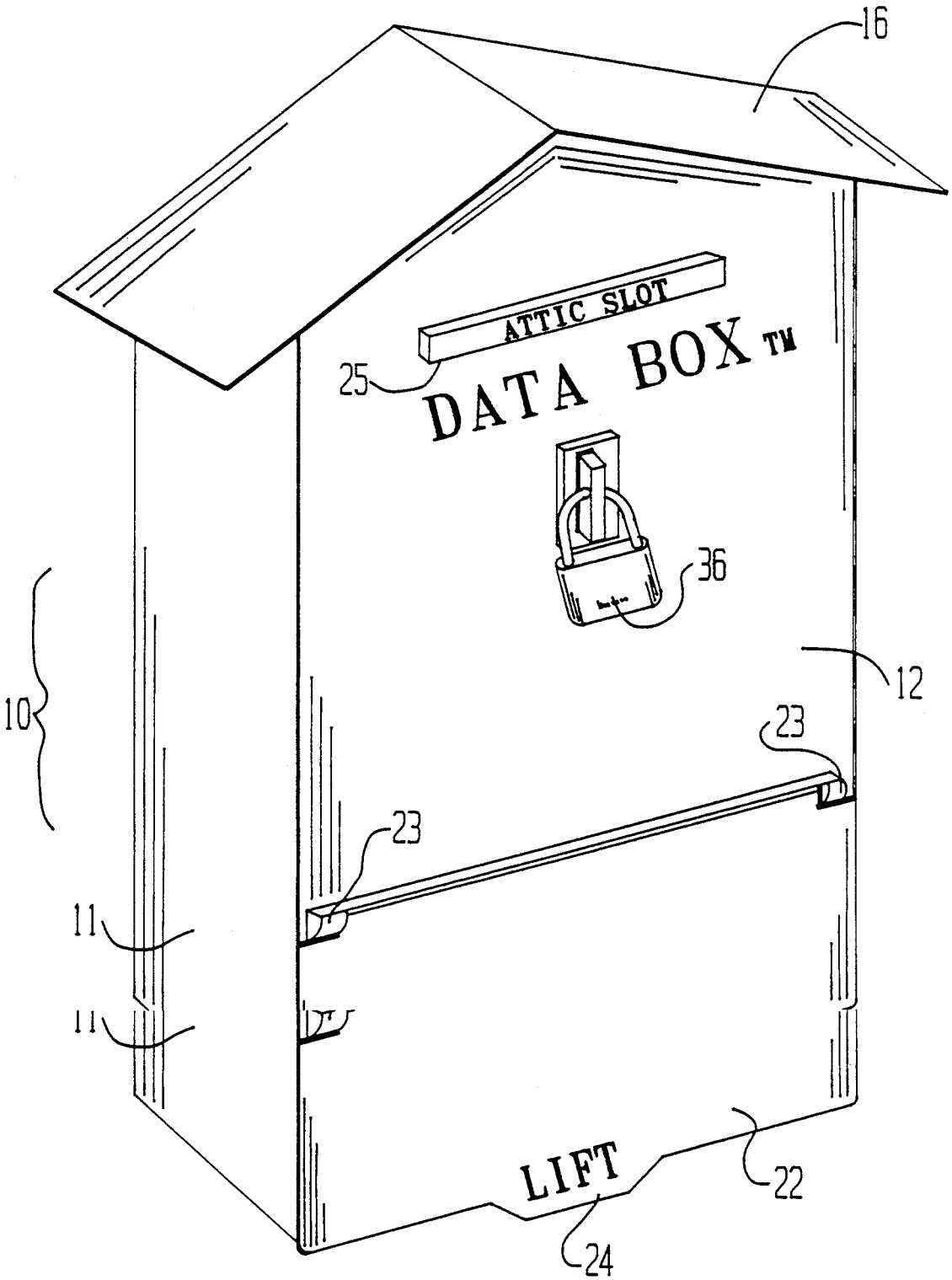
FIG. 1 is a front perspective view of the information dispensing container.
Figure 2:
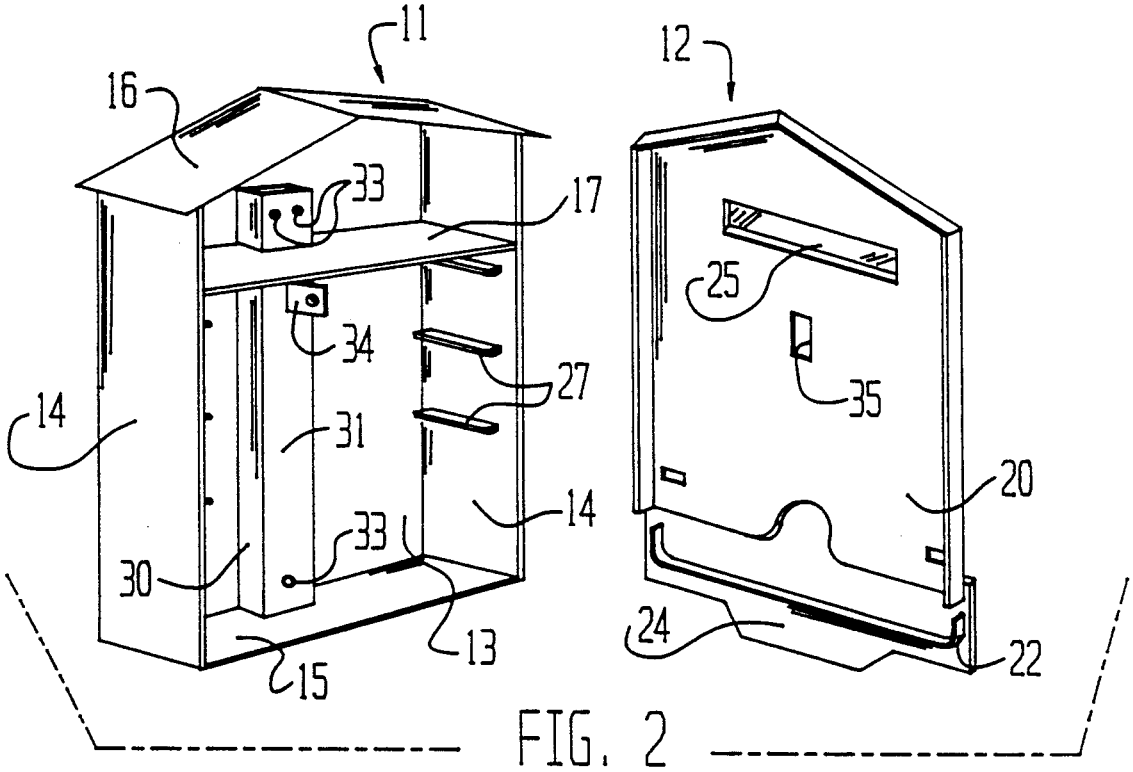
FIG. 2 is an exploded perspective view thereof.
Figure 3:
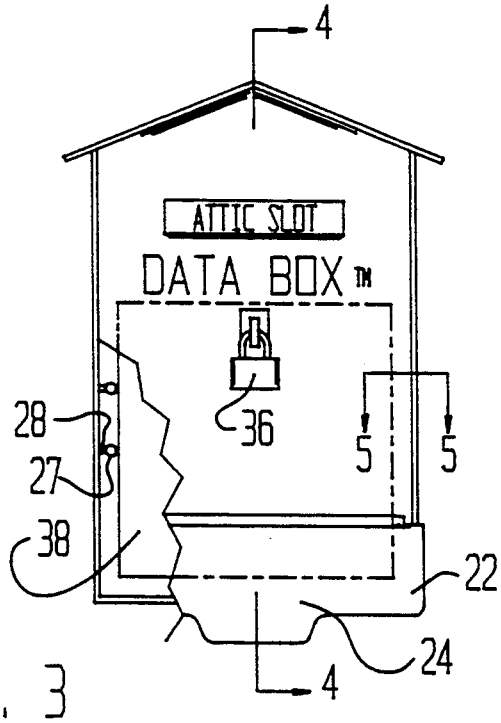
FIG. 3 is a front elevational view.
Figure 4:
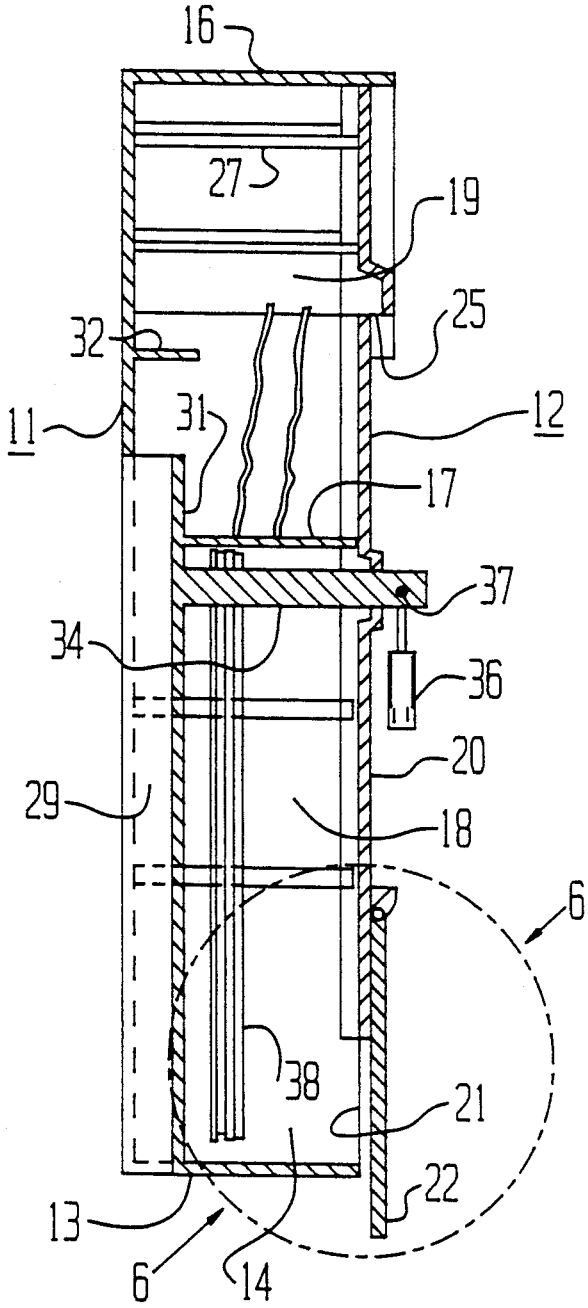
FIG. 4 a longitudinal sectional view taken along line 4—4 of FIG. 3.
Figure 5:
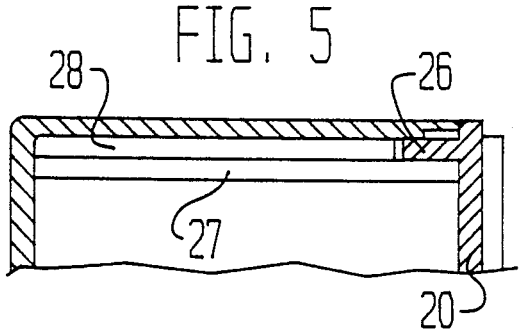
FIG. 5 is a transverse sectional view taken along line 5—5 of FIG. 3.

With reference to the drawings, and particularly FIG. 2 thereof, the information dispensing container 10 of the present invention includes a main body portion 11 and a removable front cover 12. The body portion in turn includes a rear wall 13, side walls 14, 14, a bottom wall 15 and an upper wall 16 in the form of a peaked roof having eave portions overhanging the front cover and side walls. A dividing plate 17 extending transversely between upper portions of the side walls 14, 14 divides the interior of the body into a lower chamber 18 which may contain information data sheets, more fully described hereinafter, and an upper receiving chamber 19.

Figure 6:
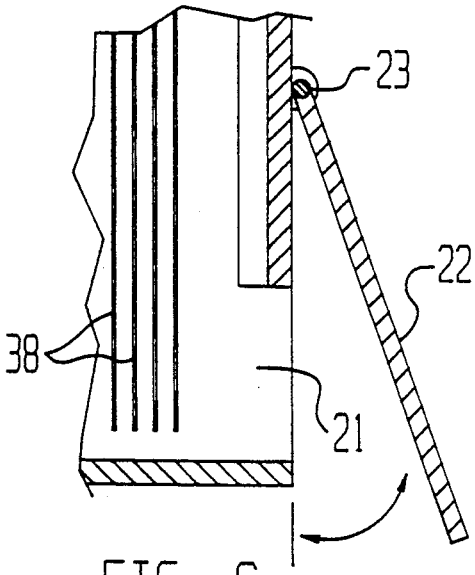
FIG. 6 is an enlarged view of the lower right-hand corner of FIG. 4 with the information access panel partially open.

The front cover 12 of the dispensing container includes a front panel 20 equal in width to that of the body portion 11, with the side edges of the front panel coextensive with the inner surfaces of the side walls 14, 14. The upper edges of the front panel conform to the shape of the peaked roof or upper wall 16 and fit tightly against the lower surfaces of this upper wall. The bottom edge of the front panel terminates short of the bottom wall 15 of the body portion 11, providing an access opening 21 to the lower chamber 18. A cover plate 22, overlying the lower edge of the front panel and pivotally connected thereto as at 23, 23 extends downwardly beyond the bottom wall 15 to cover the access opening 21. A tab 24 may be formed as part of the cover plate to permit it to be easily grasped and pivoted to an open position, as shown in FIG. 6, to uncover the access opening 21. Further, a mail slot 25 is provided extending horizontally in the upper portion of the front wall permitting a card or other material to be inserted through it into the upper chamber 16.

To position the front cover 12 within the main body portion 11, a rearwardly directed flange 26 is provided along the side and top edges of the front wall which engages against the inner surfaces of the side and top walls of the body portion. A plurality of positioning pins 27 formed integrally with the body portion 11 and spaced from the inner surfaces of the side and top walls thereof by web portions 28 engage the inner surface of the flange 26 and position the front cover 12 relative to the body portion 11.

In normal usage of the information dispensing container, it is secured to a metal stake, not shown, driven into the ground next to the usual real estate "For Sale" sign. To secure the container to the stake, a vertical recess 29 is formed at the mid-portion of the rear wall 13 by recess side and forward wall portions 30 and 31, respectively. The recess is open at its upper end and a stop member 32 is provided spaced from, but extending over, the upper end of the recess. The stake is positioned within the recess 29 extending beyond the recess into engagement with the stop member 32. Fasteners, not shown, extending through openings 33 in the recess forward wall 31 may secure the container to the stake.

It is preferable, when using the container of the present invention, to physically lock the front cover 12 to the main body portion 11. To this end, a support bar 34 is provided beneath the dividing plate 17 extending forwardly from the rear wall 13 of the body portion. When the front cover is in position on the body portion, the support bar 34 projects through an opening 35 in the front cover and a small padlock 36 may be positioned in an opening 37 at the forward end of the support bar 34 to lock the front cover in position.

To use the information containing dispenser of the present invention, it is mounted on a stake at the front of the property for sale, usually adjacent the "For Sale" sign. The front cover is removed and information data sheets 38 are suspended from the support bar 34 extending downwardly beyond the lower end of the front cover. These data sheets will contain pertinent information about the house for sale, including the asking price, a description of the rooms in the house, lot size, taxes, utility costs, age of the house, and any other information which might be pertinent to the sale of the property. They will also include a reply card with the request that the prospective purchaser complete the reply card and deposit it in the upper chamber if he is interested in being contacted further about the property. After the data sheets are in place, the front cover is locked in position. The property owner or real estate agent can then regularly check the reply card compartment and follow up with any prospective purchaser.

While a particular embodiment of the present invention has been illustrated and described herein, it is not intended to limit the invention to such a disclosure, and changes and modifications may be incorporated therein within the scope of the following claims.

What is claimed is:

1. An information dispensing container for containing information data sheets and receiving reply cards, said container including a body portion and a front cover;

said body portion having bottom, top, side and rear walls and an open front face;

said front cover extending across the open front face of the body portion extending from the top wall thereof toward the bottom wall, said front cover terminating short of the bottom wall providing an access opening to the interior of the body portion;

said top wall being in the form of a peaked roof having eave portions overhanging the side walls o the body portion and the front cover to protect the same from the elements;

support means within said body portion for supporting said information data sheets with said sheets accessible to be removed from the container through said access opening;

a cover plate pivotally mounted to said front cover to cover said access opening;

a divider plate extending between said side walls of the main body portion above said support means dividing said main body portion into a lower chamber containing the information data sheets and an upper chamber;

means defining a mail slot inn the front cover providing access to the upper chamber;

and means for securing said front cover to said main body portion.

2. An information dispensing container in accordance with claim 1 wherein an inwardly directed flange is provided adjacent the side and top of the front cover adapted to engage the inner surfaces of the side and top walls of the body portion, and positioning means on the body portion to engage the inner surface of said flange to position the same relative too the body portion.

3. An information dispensing container inn accordance with claim 1 including removable locking means to lock said front cover to said body portion.

4. An information dispensing container in accordance with claim 1 including mounting means for the container extending vertically in the rear wall thereof, said mounting means including wall portions forming a recess in the rear wall, and a stop member positioned above said recess.

* * * * *